US011655639B2

(12) United States Patent
Hering et al.

(10) Patent No.: US 11,655,639 B2
(45) **Date of Patent: *May 23, 2023**

(54) MODULAR SPRUNG FLOOR

(71) Applicants: Spencer Gavin Hering, Miami, FL (US); Manuel Reyes, Newport, RI (US); Chase Crawford, Newport, RI (US); Zachary Schulze, Newport, RI (US)

(72) Inventors: Spencer Gavin Hering, Miami, FL (US); Manuel Reyes, Newport, RI (US); Chase Crawford, Newport, RI (US); Zachary Schulze, Newport, RI (US)

( * ) Notice: Subject to any disclaimer, the term of this patent is extended or adjusted under 35 U.S.C. 154(b) by 188 days.

This patent is subject to a terminal disclaimer.

(21) Appl. No.: 17/302,865

(22) Filed: May 13, 2021

(65) Prior Publication Data

US 2021/0355691 A1 Nov. 18, 2021

Related U.S. Application Data

(63) Continuation-in-part of application No. 16/813,450, filed on Mar. 9, 2020, now Pat. No. 11,047,138.

(51) Int. Cl.
*E04F 15/22* (2006.01)

(52) U.S. Cl.
CPC ..... *E04F 15/225* (2013.01)

(58) Field of Classification Search
CPC ..... E04F 15/22; E04F 15/225
See application file for complete search history.

(56) References Cited

U.S. PATENT DOCUMENTS

| | | | | |
|---|---|---|---|---|
| 2,115,238 | A * | 4/1938 | Stevens | E04F 15/225 52/480 |
| 2,862,255 | A * | 12/1958 | Nelson | E04F 15/225 52/480 |
| 4,644,720 | A * | 2/1987 | Schneider | E04F 15/04 52/392 |
| 4,890,434 | A * | 1/1990 | Niese | E04F 15/225 52/480 |
| 5,303,526 | A * | 4/1994 | Niese | E04F 15/225 52/480 |
| 5,433,052 | A * | 7/1995 | Niese | E04F 15/225 52/480 |
| 7,874,115 | B2 * | 1/2011 | Thiede | E04B 5/02 52/220.1 |
| 10,329,777 | B2 * | 6/2019 | Hering | E04C 2/22 |
| 10,731,359 | B2 * | 8/2020 | Hering | E04F 15/225 |
| 11,047,138 | B2 * | 6/2021 | Hering | E04F 15/22 |
| 2004/0211137 | A1 * | 10/2004 | Thiede | E04B 5/02 52/272 |
| 2008/0295437 | A1 * | 12/2008 | Dagger | E04F 15/02 52/584.1 |
| 2021/0355691 | A1 * | 11/2021 | Hering | E04F 15/22 |

* cited by examiner

*Primary Examiner* — James M Ference

(57) ABSTRACT

A method, system and apparatus for a modular sprung floor. An example embodiment is a sprung floor module having interchangeable components. Interchangeable components make up standardized assemblies. An example embodiment has a frame module that may be installed in a series to cover an area. The frame module comprises a frame that supports a performance surface. Standardized components include fiber-reinforced composite linear-structural members combined with elastomeric support members.

3 Claims, 7 Drawing Sheets

132

200

MODULAR SPRUNG FLOOR

This application is a continuation-in-part application of U.S. patent application Ser. No. 16/813,450 filed 2020 Mar. 9.

TECHNICAL FIELD

The present disclosure relates to modular floor systems and impact and shock-absorbing floors.

BACKGROUND

A sprung floor is a floor that is designed to absorb impact or vibration. Such floors are used for dance and indoor sports, martial arts and physical education to enhance performance and reduce injury. Impact injuries and repetitive stress injuries are mitigated by sprung floors.

Sprung-floor requirements are similar for dance or sports. Aspects of sprung floors include: stability; balance; flatness; flexion to prevent injuries without being so soft as to cause fatigue; sufficient traction to avoid slipping without causing one's foot to twist due to excessive grip.

Common construction methods include woven slats of wood or wood with high-durometer rubber pads between the wood and sub-floor, or a combination of the woven slats with rubber pads. Some sprung floors are constructed as permanent structures while others are composed of modules that slot together and can be disassembled for transportation. When constructed, a gap is left between the sprung floor and walls to allow for expansion and contraction of the sprung-floor materials.

The surface of a sprung floor is referred to as the performance surface and may be constructed of either a natural material such as solid or engineered wood or may be synthetic such as vinyl, linoleum or other polymeric construction. The surface upon which a sprung floor is installed is referred to as the sub-floor.

Some pads or shock absorbers used in sprung-floor construction are made of rubber or elastic polymers. The term elastic polymer is commonly referred to as rubber. Elastomers are amorphous polymers having viscosity and elasticity with a high failure strain compared to other polymers. Rubber is a naturally occurring substance that is converted into a durable material through the process of vulcanization. Elastomers or elastomeric materials may be thermosets or thermoplastic. A thermoset material is formed and set with a heating process. Thermoset materials do not return to their liquid state upon re-heating. Thermoplastic materials return to a liquid state when subject to sufficient heat. Thermoplastic materials may be injection-molded while thermoset materials are commonly molded in low-pressure, foam-assisted molds or are formed in stock material that may be die-cut or machined.

Bending stiffness, also referred to as flexural rigidity, may be understood to be the result of a material's elastic modulus (E) multiplied by the area moment of inertia (I) of a beam cross-section, E*I. Bending stiffness or flexural rigidity may be measured in Newton millimeters squared (N*mm^2) A beam is also referred to as an elongate member.

SUMMARY

In accordance with example embodiments of the present disclosure, a method, system and apparatus for a modular sprung-floor is disclosed. An example embodiment is a sprung floor module having interchangeable components.

Interchangeable components make up standardized assemblies. An example embodiment has a frame module that may be installed in a series to cover a given area. The frame module supports a performance surface. Standardized components include linear structural members combined with elastomeric joints and support members. Linear structural members may be hollow rectangular tubes.

One skilled in the art is familiar with hollow rectangular structural members made of steel, aluminum, fiber-reinforced polymers and the like. Manufacturing methods include casting, extruding, pultrusion, laminate molding and the like. Material properties vary as to the type of material, direction of fibers of a composite and the shape of the cross section. Cost of materials and weight are dependent on specific requirements of applications. For example, fiber-reinforced structural members may be appropriate for a modular system that must be rapidly assembled, disassembled and moved, whereas a permanent installation may utilize wood, composite, polymer, aluminum or steel structural members for reasons of durability and cost.

Frame modules are made up of linear-structural members arranged in a pattern having X-axis frame members and Y-axis frame members. Elastomeric members engage with X-axis or Y-axis frame members and movably engage with linear, structural channels that are fastened to edges of adjacent performance-surface panels. In an example embodiment one elastomeric member is engaged in an array with the top and bottom of each X-axis and Y-axis frame member. Linear, structural channels join edges of performance-surface panels and support the performance surface atop elastomeric members. These linear, structural channels join together frame modules while aligning and connecting performance surface panels, and in some embodiments have a U-shaped cross section. The performance surface is made up of flat panels joined to linear, structural channels at adjacent edges, allowing for removal of a single panel in an array, by removing the fasteners that join the edges to the structural channels. Linear, structural channels provide a way of joining together performance-surface panels across frame module seams. The linear, structural channels also allow the performance surface to float atop the elastomeric supports so that the performance surface may expand and contract in varying environmental conditions without stressing the materials. Elastomeric supports between frame modules and linear, structural channels damp vibrations between performance surface panels and frame modules.

One skilled in the art understands that there are various methods for manufacturing elastomeric forms. In some embodiments the joint and support components are injection-molded. In other embodiments, elastomeric components may be manufactured by a low-pressure molding process using foamed urethane. In still other embodiments sheet metal components may be cut from stock material and bent. One skilled in the art also understands that elastomeric components may be placed between frame members and a sub-floor.

In some embodiments a two-part latch is engaged with a first part on one side of a panel and a mating, second part is engaged on the opposite side of a panel. One skilled in the art understands how such a mating latch may be used to join adjacent panels.

Other objects and features will become apparent from the following detailed description considered in conjunction with the accompanying drawings. It is to be understood, however, that the drawings are designed as an illustration and not as a definition of the limits of the invention.

BRIEF DESCRIPTION OF THE DRAWINGS

To assist those of skill in the art in making and using the disclosed floor system and associated methods, reference is made to the accompanying figures, wherein.

DESCRIPTION

Figure 1:
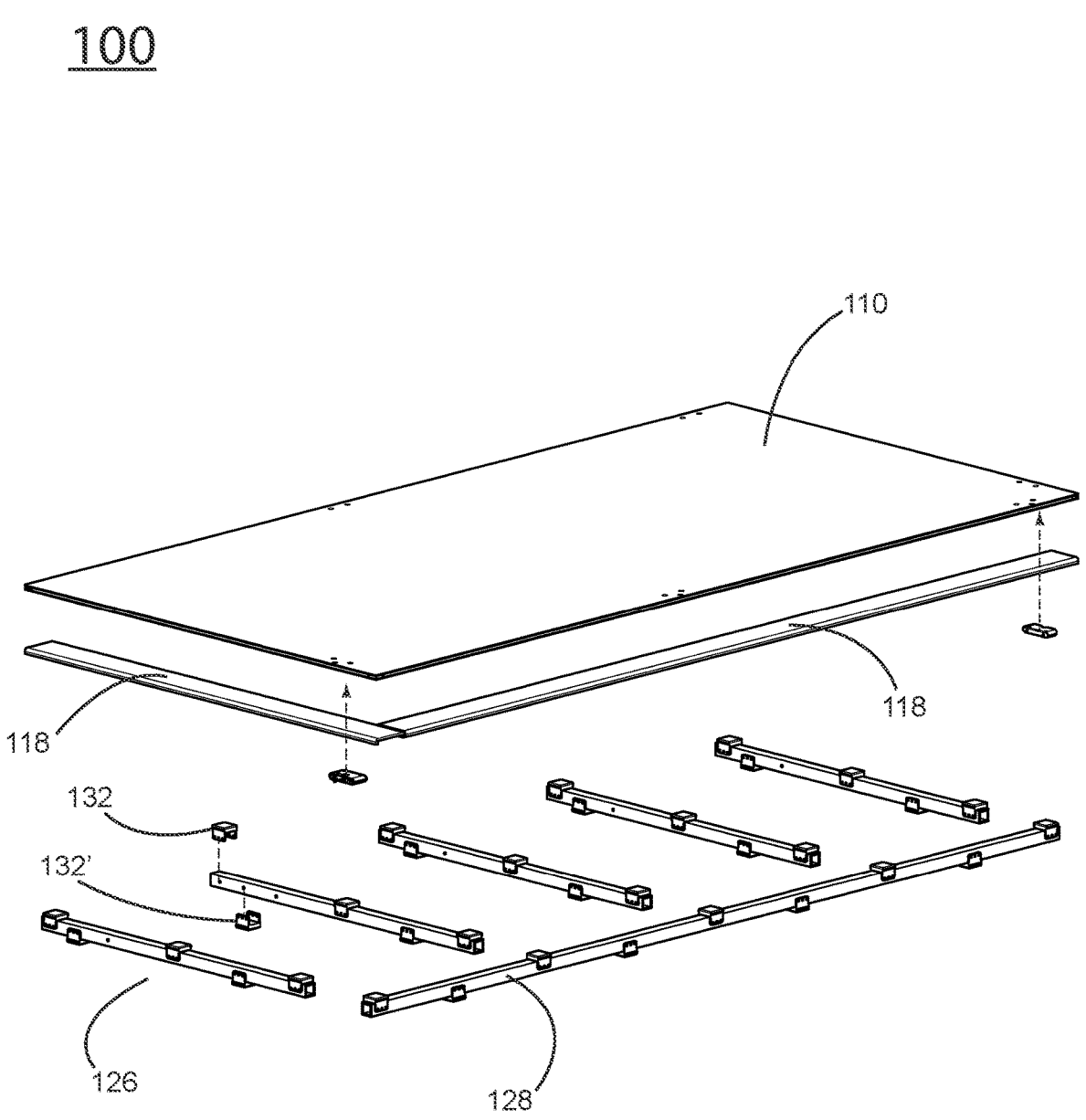
FIG. 1 is a perspective, partially exploded view of the embodiment 100.

Referring to FIG. 1, the present disclosure relates to a modular sprung-floor assembly 100. A frame assembly is arrayed in a pattern of perpendicularly placed X-axis frame members 126 and Y-axis frame members 128. Performance-surface panels 110 are supported above the frame assembly by linear, structural channels 118 that reside atop performance-surface supports 132, also referred to as pads. Pads are also used in inverted orientation 132' to support the frame assembly above a subfloor. Linear, structural channels 118 are held with fasteners about the perimeter of performance-surface panels 110, joining edges of performance-surface panels 110 firmly. By resting atop performance-surface supports 132 the performance-surface panels 110 float and shift freely over the supports 132 as the floor expands and contracts with environmental conditions, allowing seams between performance-surface panels 110 to remain tight and unstressed without the need for edge fastening as with, for example, tongue-and-groove edge treatment. Performance-surface panels 110 may be removed individually, anywhere in an array, by removing fasteners and lifting a panel 110. At some joints, the short edges of square panels meet a long edge of an adjacent panel (not shown). One skilled in the art understands that a tongue-and-groove feature may be added to performance-surface panels 110 for added alignment support.

Figure 2:
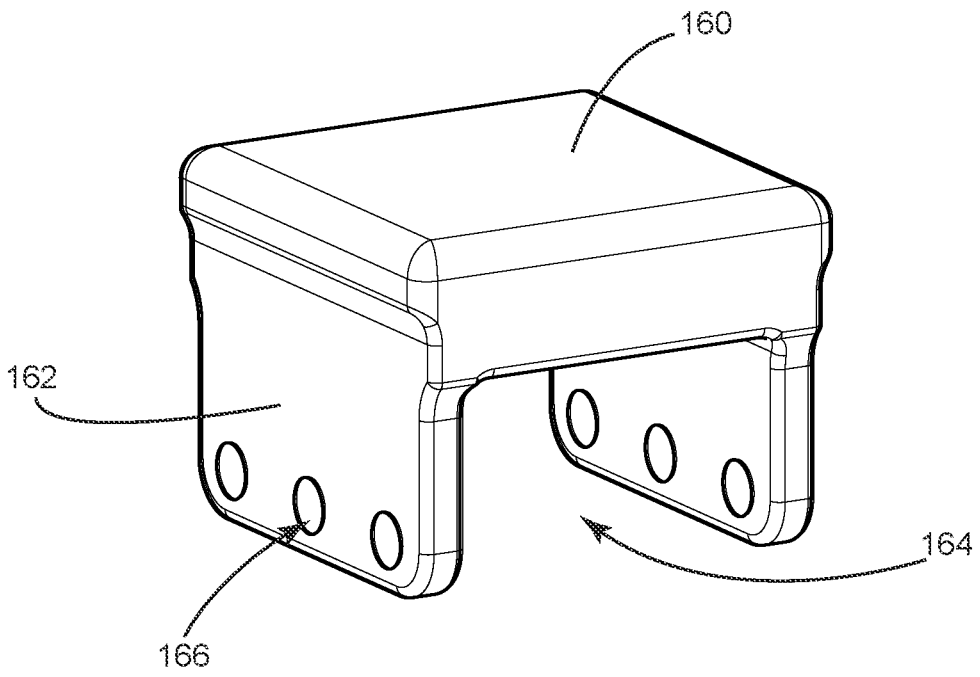
FIG. 2 is a perspective view of an elastomeric member.

FIG. 2 is a perspective view of a performance-surface support or pad 132 with a top surface 160 and side surfaces 162. Top surface 160 is designed to slidably engage with linear, structural channels 118 (FIG. 1). An aperture 164 accepts X-axis and Y-axis frame members 126 (FIG. 1). Fastener-holes 166 affix fasteners to X-axis frame members 126. One skilled in the art understands that 132 inverted (132', FIG. 1) can serve as a pad between X-axis and Y-axis members and a sub-floor.

Figure 3:
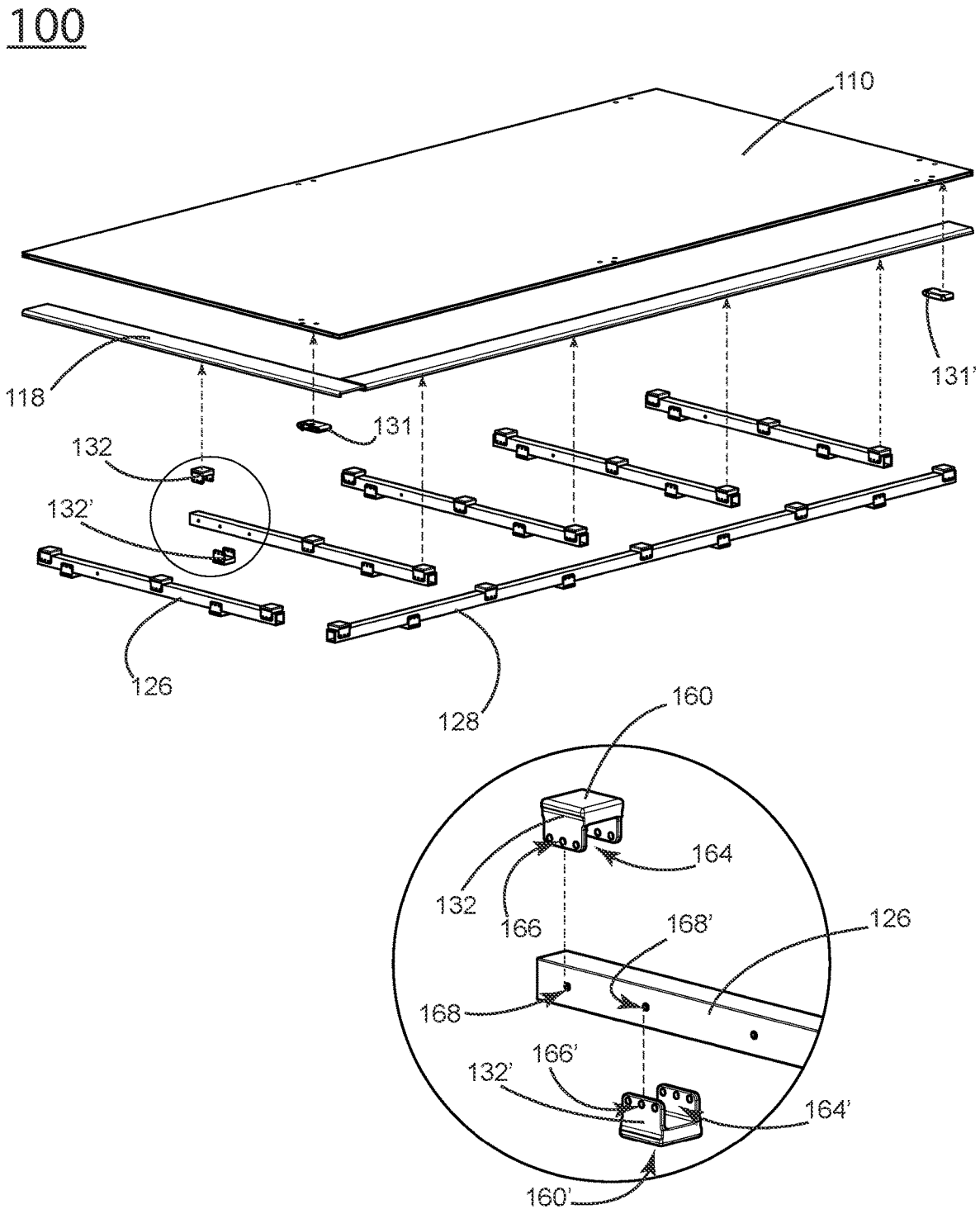
FIG. 3 is another perspective, partially exploded view of the embodiment 100.

FIG. 3 100 is a detailed view that shows the pad 132 of FIG. 2 installed on a frame member 126. Elastomeric pads 132 in their upright position support linear, structural channels 118 and performance-surface panels 110. Inverted, the elastomeric pads 132' support X-axis 126 and Y-axis frame members 128 and offset those members from a sub-floor. One skilled in the art understands that the same part may be used for both purposes; in the example of elastomeric pads 132 and elastomeric pads 132' the same manufactured part is used in an upright orientation and in an inverted orientation, performing different functions: one adheres the channels 118 (FIG. 2) and hence the frame assembly, and another damps vibrations against a sub-floor. Fastener holes 166 are configured to affix a pad 132 or 132' to X-axis or Y-axis frame members 126/128.

Figure 4:
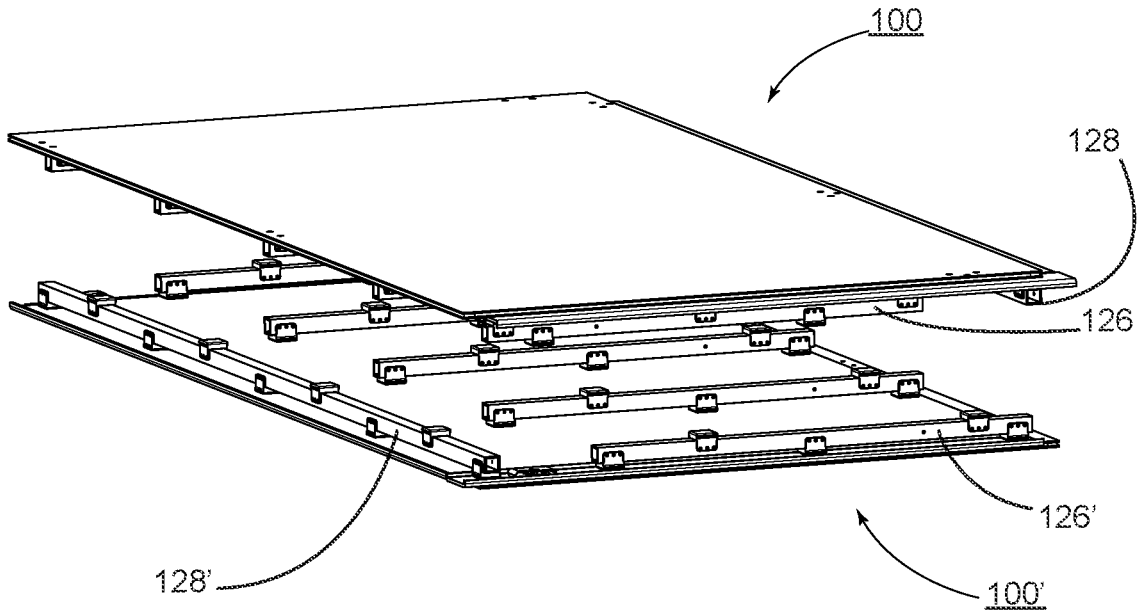
FIG. 4 is a perspective, exploded view of two example panels in a stacked orientation.
Figure 5:
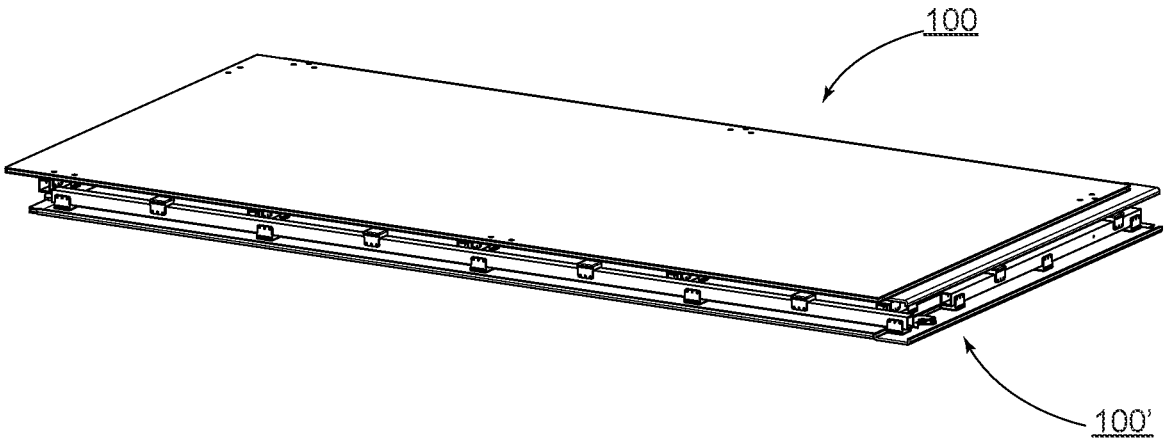
FIG. 5 is a perspective view of two example panels in a stacked orientation.
Figure 6:
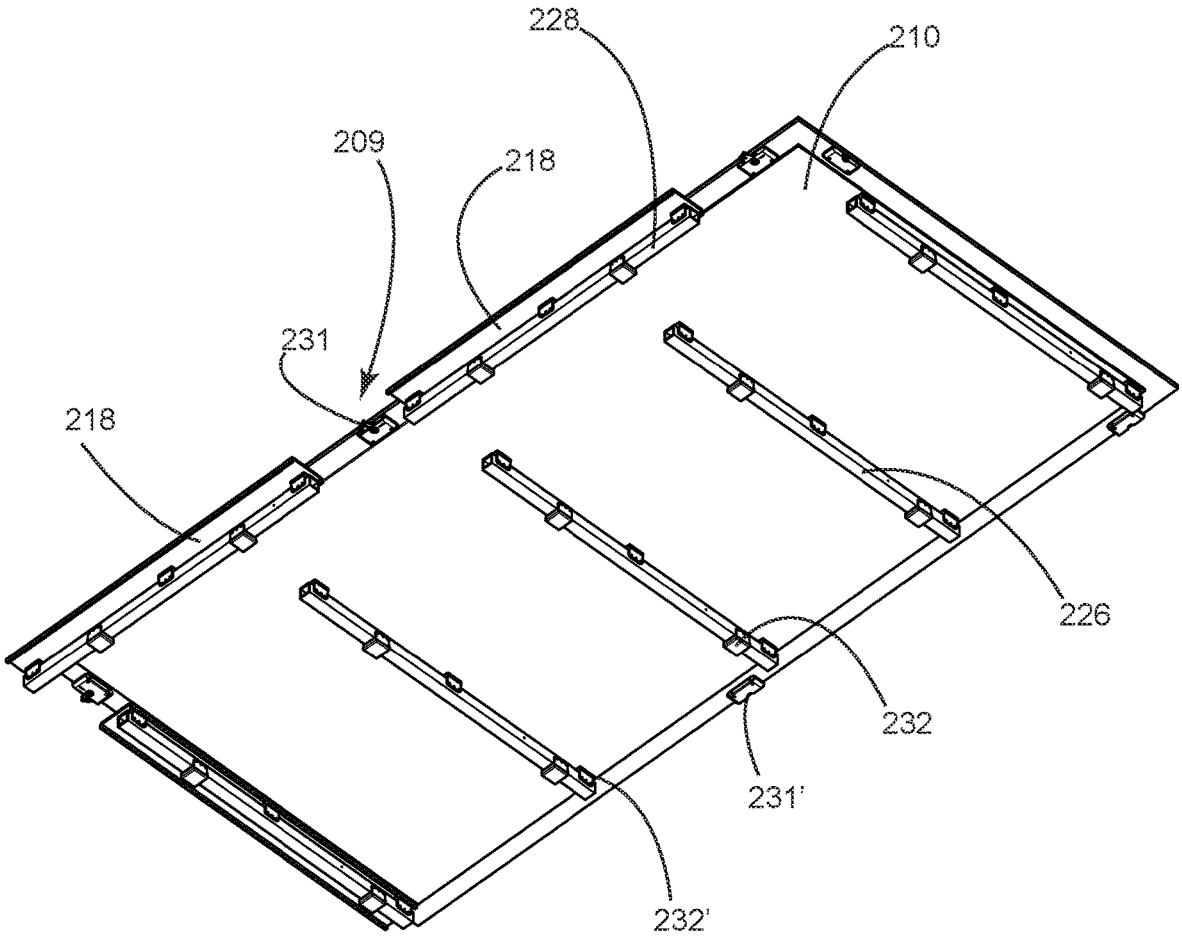
FIG. 6 is a bottom perspective view of an iteration of the embodiment.
Figure 7:
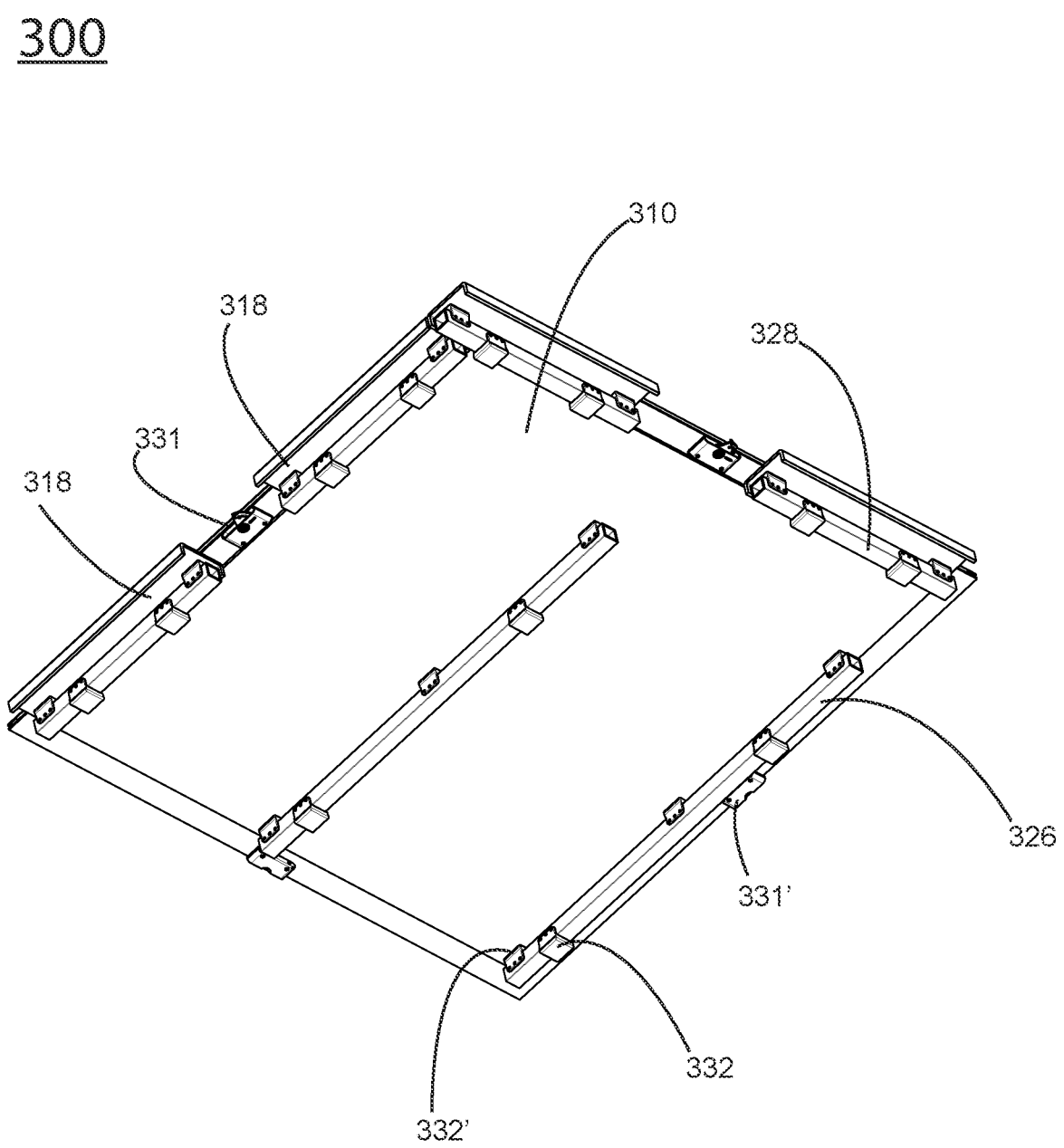
FIG. 7 is a bottom perspective view of the iteration of FIG. 6.

FIG. 4 is a perspective, exploded view showing an example embodiment 100 and example embodiment 100' in position to be stacked. FIG. 5 is a perspective view of the two examples 100 and 100' in a stacked position. One skilled in the art will understand that X-axis frame members 126 may align beside X-axis frame members 126,' and Y-axis members 128 may reside opposite Y-axis members 128'. When arranged in this orientation the example embodiment 100 will stack against example embodiment 100'.

The invention claimed is:

1. A modular structure for a sprung floor comprising:

at least two elongate members parallel to an X-axis; and at least one elongate member parallel to a Y-axis and perpendicular to said X-axis; and at least two elastomeric pads, each having a planar surface portion; and said at least two elastomeric pads fixedly engaged, in an upright orientation, with said elongate members parallel to the X axis and with said elongate members parallel to the Y-axis; and said at least two elastomeric pads fixedly engaged, in an inverted orientation, with said elongate members parallel to the X-axis and with said elongate members parallel to the Y axis; and at least two performance-surface panels; and at least one linear, structural channel having a first end and a second end, a right side and a left side and an elongate centerline extending from said first end to said second end; and wherein;

said planar surface portion of said at least two elastomeric pads which are fixedly engaged, in an inverted orientation, with said elongate members parallel to the X-axis and Y-axis being movably engaged with a sub-floor; and said planar portion of said at least two elastomeric pads which are fixedly engaged, in an upright orientation, with said elongate members parallel to the X-axis and Y-axis being movably engaged with said linear structural channel and said linear structural channel fixedly engaged with adjacent edges of performance-surface panels, said performance-surface panels substantially covering said modular structure, providing a sprung floor.

2. The modular structure of claim 1 wherein the at least two elastomeric pads have a top surface, at least one side surface, an aperture for receiving said elongate members parallel to the X-axis and said elongate members parallel to the Y-axis and holes in said at least one side surface for inserting fasteners therethrough.

3. The modular structure of claim 1 wherein:

the arrangement of X-axis members and Y-axis members allow for a first modular structure to nest with a second modular structure; wherein the first modular structure is inverted with respect to the second modular structure.

* * * * *